US008887906B2

(12) United States Patent
Holford

(10) Patent No.: US 8,887,906 B2
(45) Date of Patent: Nov. 18, 2014

(54) PACK FOR SMOKING ARTICLES

(71) Applicant: British American Tobacco (Investments) Limited, London (GB)

(72) Inventor: Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/778,041

(22) Filed: Feb. 26, 2013

(65) Prior Publication Data

US 2013/0168271 A1 Jul. 4, 2013

Related U.S. Application Data

(63) Continuation of application No. 12/522,521, filed as application No. PCT/GB2008/000050 on Jan. 8, 2008, now Pat. No. 8,413,806.

(30) Foreign Application Priority Data

Jan. 15, 2007 (GB) ..... 0700744.6

(51) Int. Cl.

| | |
|---|---|
| ***B65D 85/10*** | (2006.01) |
| ***B65D 5/66*** | (2006.01) |
| ***A24F 15/12*** | (2006.01) |

(52) U.S. Cl.

CPC ..... *B65D 85/1045* (2013.01); *B65D 5/6608* (2013.01); *A24F 15/12* (2013.01)

USPC ..... 206/268; 206/273; 229/160.1

(58) Field of Classification Search

USPC ..... 206/242, 265, 266, 268, 271, 273, 1.5; 229/87.13, 160.1

See application file for complete search history.

(56) References Cited

U.S. PATENT DOCUMENTS

| | | | | | |
|---|---|---|---|---|---|
| 2,848,152 | A | * | 8/1958 | Geiger, Sr. | 229/160.1 |
| 2,946,499 | A | * | 7/1960 | Creelman | 229/160.1 |
| 3,078,030 | A | * | 2/1963 | Gerton | 229/160.1 |
| 3,204,854 | A | | 9/1965 | Sarsfield | |
| 4,294,399 | A | * | 10/1981 | Wilfer | 229/160.1 |

(Continued)

FOREIGN PATENT DOCUMENTS

| | | |
|---|---|---|
| DE | 1078934 B | 3/1960 |
| EP | 1103369 A2 | 5/2001 |
| EP | 1615830 B1 | 7/2008 |
| WO | WO96/09230 | 3/1996 |

OTHER PUBLICATIONS

'Annex to the Communication—Opposition' dated Jan. 9, 2013, for related application EP2125539.

(Continued)

*Primary Examiner* — Luan K Bui

(74) *Attorney, Agent, or Firm* — N W Poulsen; LA Pinol

(57) ABSTRACT

One embodiment of the invention provides a hinged-lid pack (1) for smoking articles such as cigarettes. The pack comprises a body (4) and a lid (5) each having respective front (12,22), back (13,23) and opposing side panels (11A, 11B, 21A,21B). The back panel of the lid (3) is hinged to the back panel of the body. At least one side panel of the lid is provided with an inner tab (201A,201B) extending substantially coplanar with the side panel of the lid to resist opening of the lid.

23 Claims, 7 Drawing Sheets

(56) References Cited

U.S. PATENT DOCUMENTS

| | | | | | |
|---|---|---|---|---|---|
| 4,526,317 | A | * | 7/1985 | Cassidy | 229/160.1 |
| 4,569,475 | A | * | 2/1986 | Cassidy | 229/225 |
| 4,753,383 | A | | 6/1988 | Focke et al. | |
| 4,753,384 | A | | 6/1988 | Focke et al. | |
| 5,341,925 | A | | 8/1994 | Fleenor et al. | |
| 5,366,077 | A | * | 11/1994 | Pham | 206/268 |
| 5,904,244 | A | * | 5/1999 | Focke et al. | 206/268 |

OTHER PUBLICATIONS

Notice of Opposition, issued from the European Patent Office on Sep. 30, 2011 for European Patent No. EP2125539B1, granted Dec. 29, 2010.

International Preliminary Report on Patentability, dated Jul. 21, 2009, for PCT International Application No. PCT/GB2008/000050, filed Jan. 8, 2008.

Written Opinion, dated Jul. 15, 2009, for PCT International Application No. PCT/GB2008/000050, filed Jan. 8, 2008.

International Search Report, dated Mar. 31, 2008, for PCT International Application No. PCT/GB2008/000050, filed Jan. 8, 2008.

"Maintenance of the patent with the documents specified in the final decision," dated May 13, 2014, for corresponding European Patent No. EP2125539. (1 page).

"Decision to maintain the European patent in amended form (Art. 101(3)(a) EPC)," dated Jul. 3, 2014, for corresponding European Patent No. EP2125539. (2 pages).

* cited by examiner

Standard HLC

PACK FOR SMOKING ARTICLES

CLAIM FOR PRIORITY

This application is a continuation of and claims the benefit under 35 U.S.C. §120 to U.S. patent application Ser. No. 12/522,521, titled "Pack for Smoking Articles," filed Jan. 22, 2010, and issued as U.S. Pat. No. 8,413,806 on Apr. 9, 2013, which in turn claims priority under 35 U.S.C. §§365 and 371 to corresponding PCT Application No. PCT/GB2008/000050, titled "A Pack for Smoking Articles," filed Jan. 8, 2008, which in turns claims priority to GB application number 0700744.6, filed Jan. 15, 2007. The entire contents of the aforementioned applications are herein expressly incorporated by reference.

FIELD OF THE INVENTION

The present invention relates to a pack for smoking articles such as cigarettes.

BACKGROUND

It is very common to sell cigarettes in a hinged-lid (HL) carton or pack made of cardboard or other such material. A HL pack is generally provided with a transparent outer cellophane wrapping. This wrapping is then removed by a consumer in order to gain access to the cigarettes or other smoking articles contained in the pack.

A HL pack is usually rectangular in shape and comprises a body portion and a lid portion having a hinged attachment to one another. The body comprises opposing front and back panels, two opposing side panels, and a bottom panel, while the lid comprises opposing front and back panels, two opposing side panels, and a top panel opposing the bottom panel of the body. The back panels of the lid and body are joined together by the hinged attachment. The side panels and front panel of the body abut corresponding side and front panels of the lid when the lid is closed. The binge line between the back panels is generally higher (nearer the top of the pack) than the line of abutment between the front panels, so the lines of abutment between the lid and body side panels slop diagonally downwards towards the front of the pack.

HL packs are generally provided with an inner frame which is glued to the inside of the body portion of the pack. The inner frame typically comprises a front panel and opposing side panels which extend past the line of abutment between the body and the lid. Consequently, if the lid does not mate exactly with the body of the pack, the inner frame prevents the product inside the pack from being exposed.

One known problem with existing HL packs is that the lid may not always stay completely shut, especially after the cellophane wrapping has been removed. Most frequently, the lid may sit slightly ajar of the pack, although in more extreme cases, the lid may flop open completely. This tendency is sometimes known as yawning. Such yawning can assist unwanted ingress/egress to/from the pack—e.g. moisture loss from the cigarette tobacco. If the lid becomes very loose, there is a risk that some of the contents may fall out when the pack is lifted. In addition, a pack with an improperly closed lid generally has a low quality appearance.

Yawning tends to become an increasing problem as cigarettes or other smoking articles are consumed from the pack. There are two main reasons for this. Firstly, movement of the lid may be opposed by frictional engagement with the inner frame. However, this frictional engagement is generally reduced by repeated opening and closing of the lid (to access products in the pack), for example as the cardboard of the pack becomes worn and/or bent. Secondly, a pack is normally designed such that there is a slight interference (usually less than 1 mm) between the product in the pack (when full) and the opening action of the lid. In other words, opening the lid of a full pack of cigarettes requires a slight, temporary compression of some of the cigarettes in the pack. However, after some of the cigarettes have been removed from the pack, this allows space for the remaining cigarettes to move at least partly towards the rear of the pack, thereby removing any interference between the cigarettes and the opening action of the lid.

U.S. Pat. No. 5,904,244 discloses a hinge-lid carton for cigarettes with a closure aid to help keep the pack shut. The closure aid involves inner side tabs that extend up from the side walls of the body of the pack to engage inner side tabs within the lid of the pack. Another known mechanism to address yawning is to provide outwardly facing lugs or ears on the inner frame where it extends above the body of the pack. These lugs frictionally engage the lid when it is closed, and thereby help to hold the lid in place to prevent yawning. An example of such ears can be seen in WO 96/09230. However, such lugs are not always effective, and they can sometimes lead to creasing of the inner frame (which may be formed of a less rigid material than the main body of the pack).

SUMMARY OF THE INVENTION

Accordingly, one embodiment of the invention provides a hinged-lid pack for smoking articles. The pack comprises a body and a lid each having respective front, back and opposing side panels. The back panel of the lid is hinged to the back panel of the body. At least one side panel of the lid is provided with an inner tab extending substantially coplanar with the side panel of the lid to resist opening of the lid. The inner tab may therefore serve as a form of anti-yawn mechanism to help ensure that the pack remains properly closed.

In one embodiment, the pack further comprises an inner frame attached to the inside of the body. The inner tab is received between the inner frame and the side panel of the body when the pack is closed. This configuration between the inner frame and the body side panel helps to avoid the inner tab from becoming bent or folded. In addition, friction between the inner tab and the inner frame and side panel helps to resist opening of the pack.

In one embodiment, the inner tab engages the front panel of the body when the pack is closed. For example, the inner tab may have an overlap with the front panel of the body, where the overlap is in the range 0.3-3 mm, or more particularly 0.5-2 mm, for example, approximately 1 mm. Other embodiments may have a different degree of overlap, as appropriate.

In one embodiment, the inner tab is provided with a corner to engage the front panel of the body when the pack is closed to resist opening of the lid. The inner tab is farther provided with a curved edge extending away from the corner. The curved edge is shaped to remain substantially clear of the front panel of the body during opening of the lid. Consequently, once the initial resistance to opening the lid has been overcome and the corner has disengaged from the front panel, the lid can then be opened further without significant additional resistance from the inner tab.

In the above embodiment, the engagement between the inner tab and the front panel resists opening of the lid. In other embodiments, opening of the lid may be resisted by some other mechanism, such as by friction between the inner tab and the interior of a corresponding side panel of the body portion of the pack. For example, in one embodiment; the inner tab of the lid side panel is shaped to engage a restraining member having a complementary shape on the inside of the corresponding body side panel. The inner tab includes a protrusion that engages a complementary notch in the restraining member, in this embodiment, each body side panel may comprise an inner layer and an outer layer, wherein the restraining member forms part of the inner layer.

In one embodiment, the portion of the inner tab adjacent the back of the pack lid extends below and within die side panel of the body adjacent the back of the pack. This configuration helps guide the inner tab to the inside of the pack body as the pack is being closed, from which position it can then engage the front panel of the body.

In one embodiment, the front panel of the body portion extends diagonally upwards adjacent the side panel where the front panel is engaged by the inner tab. (In one particular embodiment, the diagonal extension comprises a continuation at the same angle of a diagonal forming the top edge of the side panel of the body). The diagonal extension helps to deflect the inner tab inwardly as the lid is closed. This therefore facilitates overcoming any engagement between the inner tab and the front panel to close the pack, and also helps to guide the inner tab to the appropriate location between the side panel and the inner frame.

In one embodiment, the inner tab is formed from material folded in from the back panel of the lid, for example, by modifying a panel that is already present in many existing HL packs (although in conventional HL packs this panel is fully contained inside the lid). Accordingly, it is relatively easy to make a pack having such an inner tab using existing machinery.

In one embodiment, each of the two side panels of the lid is provided with an inner tab to engage the front panel of the body to resist opening of the lid when the pack is closed. In general the two inner tabs are the same, to provide symmetrical resistance, and may share any of the features described above.

Another embodiment of the invention provides a blank for manufacturing such a hinged-lid pack. Such a blank may be formed by modifying a blank for a conventional pack, such that the size and shape of some of the panels in the blank are changed (along with the overall size and shape of the blank).

BRIEF DESCRIPTION OF THE DRAWINGS

Various embodiments of the invention will now be described in detail by way of example only with reference to the following drawings.

DETAILED DESCRIPTION

Figure 1A:
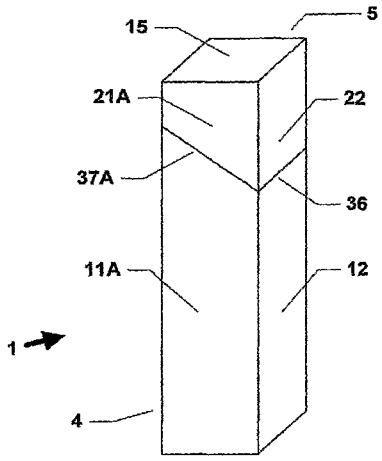
FIGS. 1*a* and 1*b* illustrate the general configuration of a hinged lid pack.
Figure 1B:
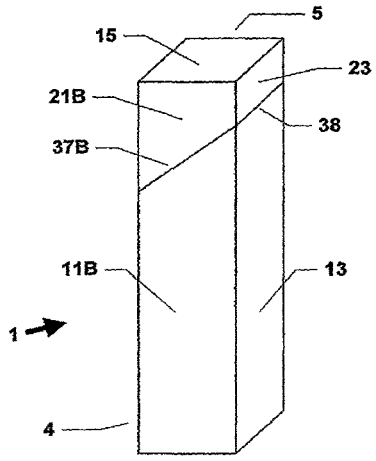

FIGS. 1A and 1B illustrate the general configuration of a hinged-lid (HL) pack 1. The HL pack is generally rectangular in shape and comprises a body portion 4 and a lid portion 5 having a hinged attachment to one another. The body comprises opposing front 12 and back 13 panels, two opposing side panels 11A, 11B, and a bottom panel (not shown in FIGS. 1A and 1B). The lid comprises opposing front 22 and back 23 panels, two opposing side panels 21A, 21B (aligned with body side panels 11A and 11B respectively), and a top panel 15 opposing the bottom panel of the lid. The body hack panel 13 and the lid back panel 23 are joined together by a hinge-line 38 which is generally parallel to the bottom of the pack.

When the pack is closed, the body front panel 12 abuts the lid front panel 22 along line 36, which is generally parallel to the bottom of the pack. The body side panels 11A, 11B abut corresponding lid side panels 21A, 21B along lines 37A and 37B respectively. Hinge line 38 is generally higher (nearer the top of the pack) than the line of abutment 36 between the body and lid front panels, so that the lines of abutment 37A, 37B between the lid and body side panels slope diagonally downwards to towards the front of the pack.

When the pack is opened, the lid portion 5 pivots around hinge line 38. This causes lid front panel 22 to separate from the front panel 12 of the body portion, and likewise for the side panels, thereby giving access to the contents of the HL pack 1.

Figure 2:
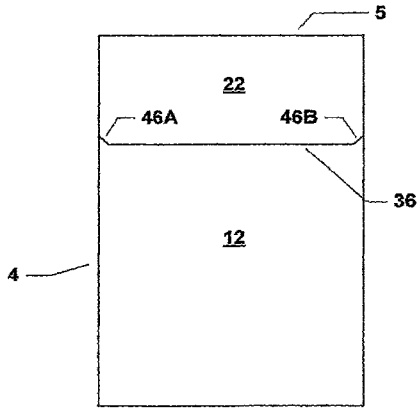
FIG. 2 is a more detailed front view of a hinged lid pack in accordance with one embodiment of the invention.

FIG. 2 illustrates in more detail the front of an HL pack in accordance with one embodiment of the invention. As can be seen in FIG. 2, the centre portion of the line of abutment 36 between the body front panel 12 and the lid front panel 22 is horizontal (parallel to the bottom of the pack). However, the body front panel 12 and the lid front panel 22 are shaped such that the two ends of the line of abutment 36 (i.e. near the edges with the side panels) are turned diagonally upwards towards the top of the pack, as indicated by line segments 46A and 46B.

In one embodiment line 46A is a continuation of line 37A on the side of the panel, and likewise line 46B is a continuation of line 37B. In other words, the angle of inclination for line 46A to the vertical or horizontal) is the same as for line 37A, and the angle of inclination for line 46B is the same as for line 37B. Another possibility is that the angle of inclination for line 46A to the vertical is more acute than for line 37A (likewise for line 46B).

In one embodiment, the length of lines 46A and 46B is in the range 1-3 mm, for example approximately 2 mm, and the inclination angle of lines 46A and 46B to line 36 is in the range 30 to 60 degrees, for example approximately 40 degrees. It will be appreciated that other embodiments may have a different length and/or inclination angle for lines 46A and 46B. For example, the angle of lines 46A and 46B will vary depending on the length of the lid (short lid or extended lid) and the format of the pack.

Figure 3:
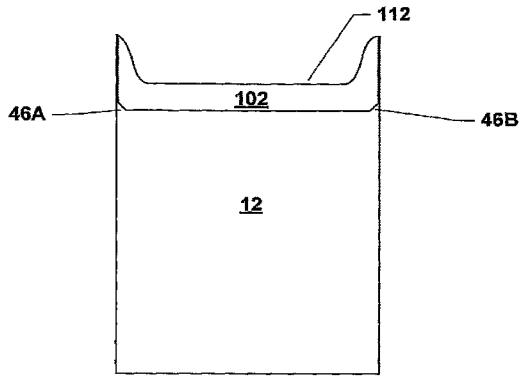
FIG. 3 is a front view of the hinged lid pack in FIG. 2, but with the lid removed.

FIG. 3 shows the HL pack of FIG. 2 with the lid 5 removed. This exposes the inner frame 102 of the pack. The inner frame generally comprises a front panel 112, and two opposing side panels 111A, 111B (frame side panel 111B is shown in FIG. 4A; the opposing side panel 111A is not visible in the Figures). The inner frame is usually attached to the body portion 4 of the pack by using adhesive to glue it) the front panel 112 of the inner frame to the interior surface of the front panel 12 of the body portion. In addition, the side panels of the inner frame, 111A and 111B, are normally glued to the interior surface of the corresponding side panels (11A and 11B respectively) of the body portion 4.

The front 112 and side panels 111A, 111B of the inner frame 102 extend above the body portion 4 of the HL pack. One reason for providing the inner frame 102 is that due to manufacturing tolerance, the body front panel 12 may not abut exactly against lid front panel 22; in other words, there may be a slight gap at line of abutment 36. Likewise, there may be a slight gap at line of abutment 37A between body side panel 11A and lid side panel 21A and/or at line of abutment 37B between body side panel 11B and lid side panel 21B. The inner frame 102 therefore serves as backing cover for any such gap along lines of abutments 36, 37A, and/or 37B. This then prevents the cigarettes or other smoking articles inside the Fit pack from being exposed to view, which would degrade the product appearance. The inner frame also acts as a barrier for ingress/egress to/from the pack, adds strength to the pack (especially when glued to the body portion), and helps to keep the lid closed.

Figure 4:
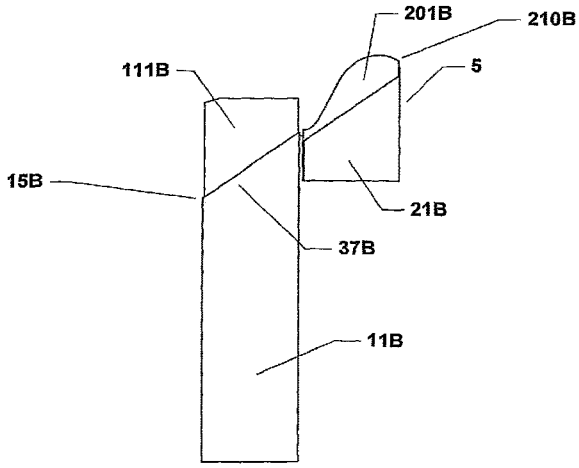
FIG. 4 is a side view of the hinged lid pack of FIG. 2 with the lid open.

FIG. 4 depicts a HL pack in accordance with one embodiment of the invention with the lid 5 open. It can be seen that the lid includes a curved extension or tab 201B that extends beyond the side panel 21B of the lid. The opposing side panel 21A of the lid is also provided with such a curved extension 201A (not visible in FIG. 4).

Figure 5:
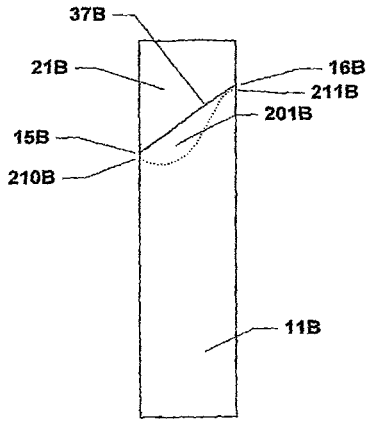
FIG. 5 is a side view of the hinged lid pack of FIG. 2 with the lid closed.

FIG. 5 depicts the HL pack of FIG. 4 with the lid closed. When the lid 5 is closed, tab 201B slides between the body side panel 11B and the inner frame side panel 111B, likewise for the tab on the opposing side of the pack. The position of tab 201B behind side panel 11B is shown in dotted outline in FIG. 5.

Tab 201B is sized and shaped so that the corner 210B of the tab sits slightly below the corner 15B of the body portion 4 of the HL pack. (Corner 15B represents the point where the top of the body front panel 12 meets the top of the body side panel 11B; this also corresponds to the junction of line 46B and line 37B). This overlap to between the body front panel 12 and the tab 201B provides resistance to opening the lid 5. Accordingly, tab 201B serves as an anti-yawn mechanism to keep the lid portion 5 fully closed against the bottom portion 4.

The degree of overlap between the body front panel 12 and the tab 201B is approximately 1 mm, although this may vary from one embodiment to another. This amount of overlap allows the HL pack to be opened, given that an HL pack is generally made of a relatively compliant material such as cardboard. In particular, when the consumer applies suitable force, the HL pack deforms slightly for the tab 201B to disengage from the front panel, thereby permitting the lid to be opened. The amount of deformation is small enough that the pack returns resiliently to its initial configuration after the lid is opened. A similar, temporary, deformation occurs when the lid is closed again, thereby allowing tab 201B to return to the position shown in FIG. 5 (thereby re-setting the anti-yawn mechanism).

The resilient deformation of the HL pack when the lid is opened and closed is assisted by the upturned ends 46A, 46B of line 36. Thus the main portion of the top of the body front panel, as indicated by line 36, is lower than the corner portion of the top of the body front panel at corner 15B. As an attempt is made to open the ilL pack, tab 201B is guided by side panel 11B and body front wall 12 adjacent corner 15B to deflect inwards, towards the region where the top of the front panel is lower (corresponding to line 36). This then allows tab 201B to clear the body front panel 12, thereby permitting the lid to be opened.

Figure 6:
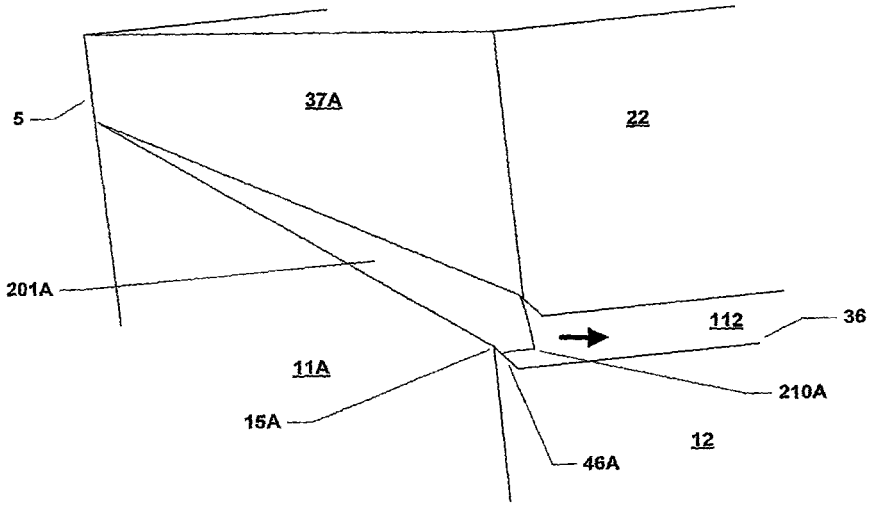
FIG. 6 is a detail of the hinged lid pack of FIG. 2 with the lid closing.

The upturned ends of the body front panel 36 are also of assistance when closing the lid 5, as shown in FIG. 6. Thus when the lid 5 is nearly closed, the edge of tab 201A adjacent corner 210A contacts corner 15A where the top of the body front panel 12 joins the top of the body side panel 11A. As the lid is further lowered, the diagonal slope of line 46A deflects or urges the corner 210A of tab 201A slightly inwards, in the direction shown by the arrow, out of the plane of side panels 11A and 37A. This moves the corner 210A away from the highest part of the body front panel 12 towards the lower portion corresponding to line 36, thereby allowing the tab 201A to clear the body front panel 12 without requiring undue force from the consumer. The tab 201A is then able to return resiliently to its original planar configuration, this action also being assisted as the tab 201A is received between the body side panel 11A and the inner frame side panel 111A (not visible). Finally, when the lid is fully closed, tab 201A is back to the anti-yawn configuration shown in FIG. 5.

In another embodiment, there is no overlap between the body front panel 12 and the tab 201B. In this embodiment, resistance to opening the pack is provided by friction between the tab 201B and the internal surface of the corresponding side panel 11B of body portion 4. For example, with reference to FIG. 6, to open lid 5, tab 201A slides past side panel 11A (which is substantially coplanar with tab 201A). The friction, associated with this sliding movement helps to keep the lid 5 closed. This resistance is increased if the pack is also provided with an inner frame 102, since tab 201A is now located between the side panel 11A of body portion 4 and the side wall 111A. (not shown in FIG. 6) of inner frame 102. This sandwich arrangement for the tab 201A provides greater friction for withdrawing the tab 201A from the side panel 11A of body portion 4 and the side wall 111A of inner frame 102.

Figure 7:
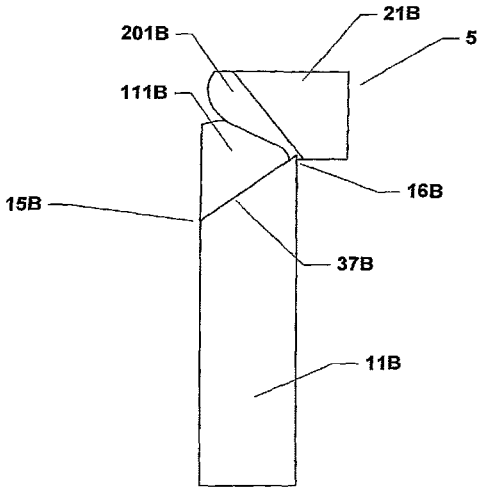
FIG. 7 is a side view of the hinged lid pack of FIG. 2 with the lid half open.

FIG. 7 illustrates an HL pack in accordance with one embodiment of the invention with the lid 5 half-open. The top corner 16B of the body side panel 11B adjacent to the body back panel 13 is at a higher level (i.e. overlaps) the bottom corner 211B of tab 201B adjacent to hinge line 38 (see also FIG. 5). In one embodiment, the overlap is in the range 0.5 mm to 2.5 mm, for example approximately 1 mm. It will be appreciated that other embodiments may have a different amount of overlap.

The overlap helps to ensure that when the lid is closed, tab 201B is received inside (rather than outside) the body side panel 11B. Although there is no overlap when the lid is fully open (as shown in FIG. 4), the bottom corner 211B of the tab portion remains close to the top corner 16B of the body side panel 11B. This restricts the possibility of significant relative movement between the two. Accordingly, when the lid starts to close, the position of corner 211B inside corner 16B is maintained, which then guides the remainder of tab 201B to pass inside side wall 11B to ensure proper operation of the anti-yawn mechanism.

Figure 8:
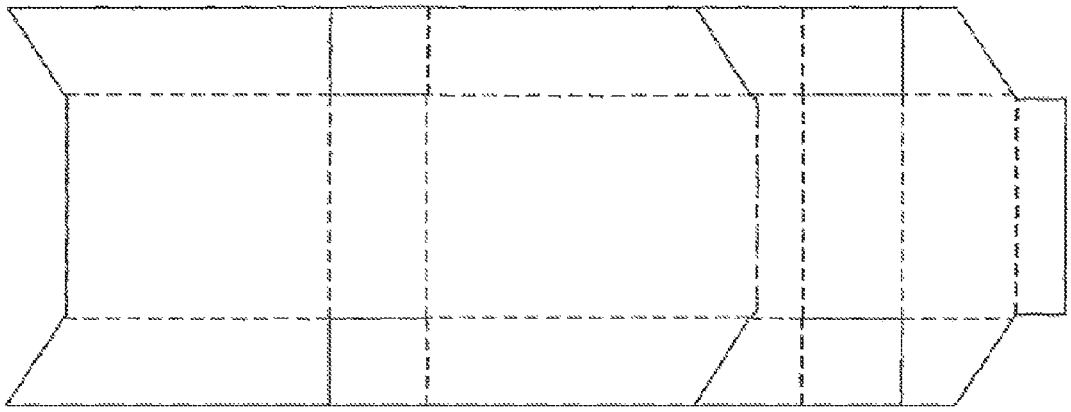
Fig 8 PRIOR ART
FIG. 8 depicts a blank for a conventional hinged lid pack.
Figure 9:
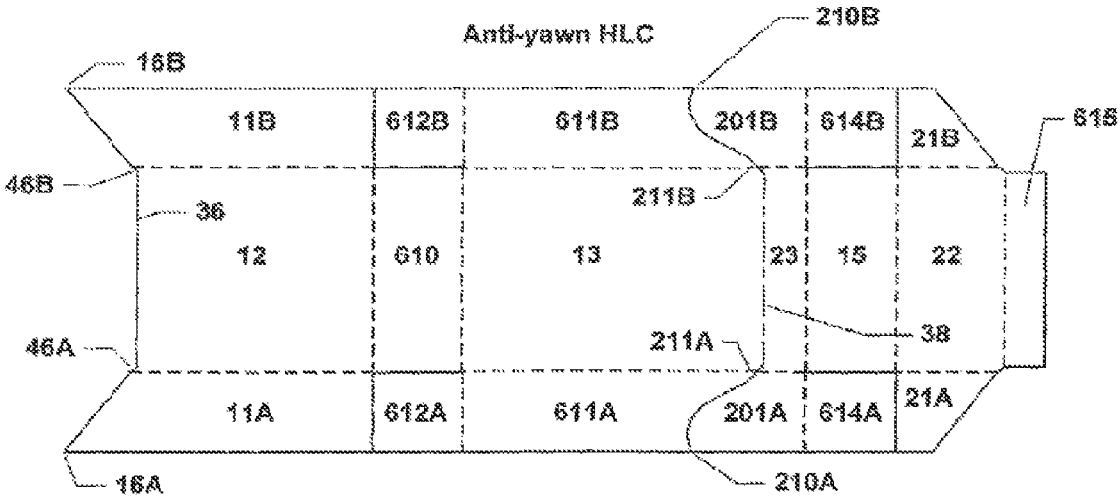
FIG. 9 depicts a blank for a hinged lid pack hi accordance with one embodiment of the invention.

FIG. 8 illustrates a blank for a conventional HL pack, with cut lines indicated by solid lines and fold lines indicated by dashed lines. FIG. 9 illustrates a blank for a HL pack in accordance with one embodiment of the invention. It will be appreciated that although the blank of FIG. 9 comprises the same set of panels as the blank of FIG. 8, and may be assembled using the same cuts and folds, the shape of the blank as a whole plus the shape of some of the panels within the blank is different for FIG. 9 compared to FIG. 8.

Both FIGS. 8 and 9 depict some additional panels that have not previously been described. These additional panels fold behind other panels, except for panel 610, which forms the bottom of the pack. Thus panel 615 folds back up behind front lid panel 22; side base panels 612A and 612B fold in over the bottom of the pack; side inner panels 611A and 611B are glued inside side panels 11A and 11B; and lid top panels 614A and 614B fold underneath lid panel 15. Note that tabs 201A and 201B are joined to lid top panels 614A and 614B respectively.

The following are the main points of distinction between the blank of FIG. 8 and the blank of FIG. 9:

a) in the blank of FIG. 8, the panels corresponding tabs 201A and 201B are coextensive with the corresponding lid side panels 21A and 21B respectively, whereas in the blank of FIG. 9, the tabs 201A and 201B are larger than corresponding lid side panels 21A and 21*b* respectively. Accordingly, in the blank of FIG. 8 the panels corresponding to tabs 201A and 201B do not extend below lid side panels 21A and 21B, and therefore, unlike the blank of FIG. 9, do not engage front panel 12 and/or corresponding body side panels 11A and 11B to provide any anti-yawn mechanism. Note also that because the tabs 201A and 201B in FIG. 9 are larger than corresponding lid side panels 21A and 21B respectively, during assembly of the pack, the full surface of lid side panel 21A can be used for gluing to tab 201A and the full surface of lid side panel 21B can be used for gluing to tab 201B. (This is in contrast to the situation with above-cited U.S. Pat. No. 5,904,244, in which the inner side tabs for the lid are reduced in size compared to the (outer) lid, side panels).

b) in the blank of FIG. 9, the tops of the body side panels 11A and 118 are extended compared to the blank of FIG. 8, as indicated by corners 16A and 168. These extended side panels act as guides to help retain tabs 201A and 201B inside the body portion of the pack.

c) in the blank of FIG. 9, the diagonal cut at the tops of the body side panels 11A and 11B are extended into the body front panel of the pack, as indicated by lines 46A and 46B. These upward extensions at the edges of the body front panel 12 help to retain tabs 201A and 201B in the closed position to provide the anti-yawn mechanism, but do allow the lid to open if the tabs 201A and 201B are deflected slightly inwards. Conversely, when the lid is being closed, the upward extensions urge the tabs 201A and 201B inwards to clear the body front panel 12, thereby allowing the lid to be closed without undue resistance. (Note that some existing IEL, packs already extend the diagonal cut at the tops of the body side panels 11A and 11B slightly around to the body front panel of the pack, primarily for aesthetic reasons).

It will appreciated that since the blank of FIG. 9 has the same overall structure as the blank of FIG. 8, in terms of panels, cuts and folds, factory machinery that already exists for making HL packs from, the blank of FIG. 8 can be readily modified to accommodate the blank of FIG. 9.

Figure 10:
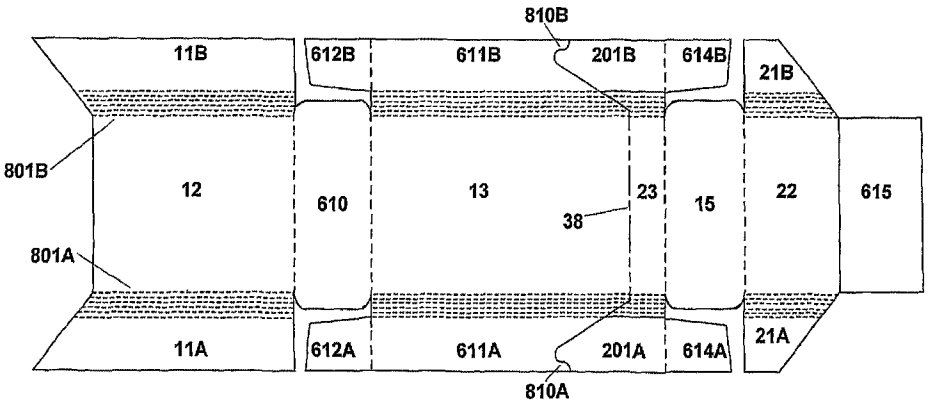
FIG. 10 depicts a blank for a hinged lid pack in accordance with one embodiment of the invention.

FIG. 10 illustrates a blank in accordance with another embodiment of the invention. This blank has many similarities with the blank of FIG. 9, and accordingly only the differences between these two blanks will be described. The edges of the pack of FIG. 10 are rounded (rather than sharp as per the blank of FIG. 9), as indicated by parallel lines 801B and 801A extending the length of the blank. In particular, in the pack assembled from the blank of FIG. 10, the edges between the front panel 12, 22 and the two side panels 11A, 11B, 21A, 21B, and likewise the edges between the back panel 13, 23 and the two side panels 11A, 11B, 21A, 21B are all rounded.

The rounded nature of these edges renders it less effective for the front edge of inner tabs 201A and 201B to engage the top of front panel 12. Accordingly, the blank of FIG. 10 supports a different anti-yawn mechanism, based on the shape of the out 810 between side inner panels 611 and the inner tabs 201. In particular, the cut 810 involves complementary shaping of the side inner panels 611 and the inner tabs 201 to provide engagement or interlocking of the side inner panels 611 and the inner tabs 201. Note that in the blank of FIG. 10, the inner tabs 201 are still larger than the corresponding lid side panels 21 and so extend below these side panels (as for the blank of FIG. 9).

Figure 11:
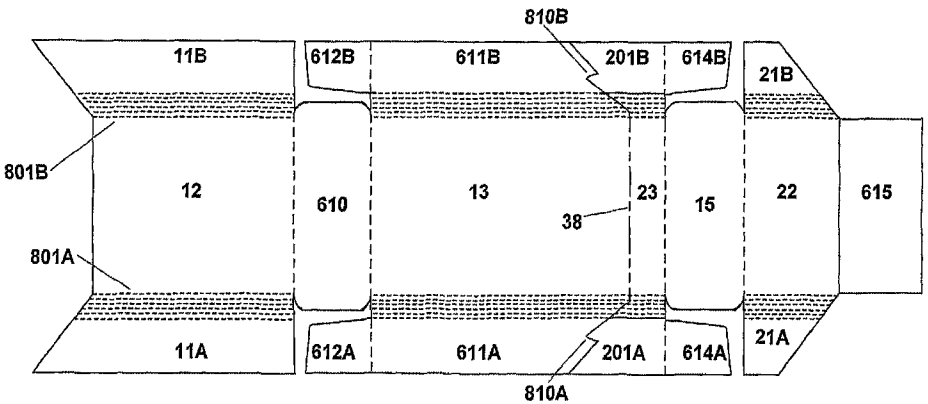
FIG. 11 depicts a blank for a hinged lid pack in accordance with one embodiment of the invention.

FIG. 11 illustrates a blank in accordance with another embodiment of the invention. This blank is substantially the same as the blank of FIG. 10, except that the cut between the inner tabs 201 and the side panels 611 is different, in particular regarding the complementary shape at 810. It will be appreciated that many further possible cuts for the complementary shape 810 will be apparent to the skilled person.

Figure 12:
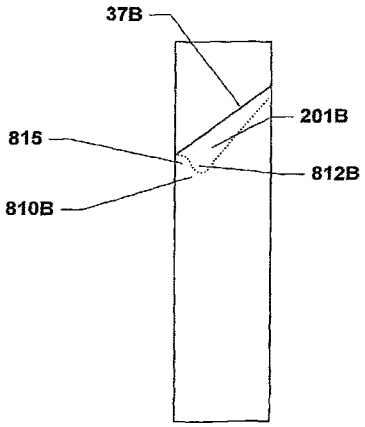
FIG. 12 is a side view of the hinged lid, pack formed from the blank of FIG. 10 with the lid closed.

FIG. 12 illustrates the way in which the complementary shaping 810 (as indicated by the dotted line) acts to restrain the lid from opening when the pack is closed. Thus the inner tab 201B includes a protrusion or extension 812B directed downwards towards the base. (body) of the pack. This protrusion is received into a corresponding notch or recess formed within the inner body side panel. This recess is bounded at the front of the pack by extension 815 on the side inner panel, which is directed upwards towards the top (lid) of the pack.

If a user tries to open the pack, the protrusion 812 abuts (edge-to-edge) against the extension 815 to resist opening of the pack. As slightly more force is applied to open the pack, protrusion 812 and/or extension 815 deforms (resiliently), so that they are no longer in the same plane. This allows protrusion 812 to therefore slide past extension 815, thereby permitting the lid to open. When the pack is closed, the protrusion 812 and extension 815 return to the positions shown in FIG. 12 to re-activate the anti-locking mechanism.

Although various embodiments of the invention have been described, many further variations and modifications will be readily apparent to the skilled person. For example, although the present approach has been described generally in the context of cigarettes, it can be applied to a wider range of smoking articles, e.g, cigars. In addition, the embodiments described and illustrated herein refer to packets in which the edges are formed by the panels at right angles with rounded edges. However, a packet could also be formed with any other shape known in the art. Accordingly, the scope of the present invention is defined by the appended claims and their equivalents.

The invention claimed is:

1. A hinged-lid pack for smoking articles comprising:

a body and a lid, each having respective front, back and opposing side panels, the lid back panel hingedly connected to the body back panel, and at least one lid side panel having an inner tab extending substantially coplanar with the lid side panel, the inner tab configured to engage the body front panel and resist opening of the lid when the pack is closed, the portion of the inner tab adjacent the lid back panel configured to locate within the body side panel adjacent the body back panel prior to the remainder of the inner tab as the lid is being closed, and the body front panel extending diagonally upwards adjacent the side panel where the body front panel engages the inner tab, said diagonal extension configured to deflect the inner tab inwardly as the lid is closed.

2. The pack of claim 1, further comprising an inner frame attached to the inside of the body, wherein said inner tab is received between said inner frame and the body side panel when the pack is closed.

3. The pack of claim 1, wherein the inner tab is provided with a corner to engage the body front panel when the pack is closed to resist opening of the lid and a curved edge extending away from said corner, wherein said curved edge is shaped to remain substantially clear of the body front panel during opening of the lid.

4. The pack of claim 1, wherein the inner tab coplanar with the lid side panel engages the body front panel when the pack is closed by having an overlap with the body front panel in the range 0.3-3 mm.

5. The pack of claim 4, wherein the inner tab coplanar with the lid side panel engages the body front panel when the pack is closed by having an overlap with the body front panel in the range 0.5-2 mm.

6. The pack of claim 5, wherein the inner tab coplanar with the lid side panel engages the body front panel when the pack is closed by having an overlap with the body front panel of approximately 1 mm.

7. The pack of claim 1, wherein the inner tab of the lid side panel is shaped to engage a restraining member having a complementary shape on the inside of the corresponding body side panel.

8. The pack of claim 7, wherein the inner tab includes a protrusion that engages a complementary notch in the restraining member.

9. The pack of claim 7, wherein each body side panel comprises an inner layer and an outer layer, and wherein said restraining member forms part of said inner layer.

10. The pack of claim 1, wherein said diagonal extension comprises a continuation at the same angle of a diagonal forming the top edge of the body side panel.

11. The pack of claim 1, wherein said inner tab is formed from material folded in from the lid back panel.

12. The pack of claim 1, wherein each of the two lid side panels is provided with an inner tab to resist opening of the lid when the pack is closed.

13. A hinged-lid pack for smoking articles, comprising: a body and a lid each having respective front, back and opposing side panels, wherein the lid back panel is hinged to the body back panel, and wherein at least one lid side panel is provided with an inner tab extending substantially coplanar with the lid side panel, the inner tab configured to engage the body front panel and resist opening of the lid when the pack is closed, the portion of the inner tab adjacent the lid back panel extending below a line of abutment between the lid side panel and the body side panel when the pack is not fully open, and the body front panel extending diagonally upwards adjacent the side panel where the body front panel engages the inner tab, said diagonal extension configured to deflect the inner tab inwardly as the lid is closed.

14. The pack of claim 13, further comprising an inner frame attached to the inside of the body, wherein the inner tab is received between said inner frame and the body side panel when the pack is closed.

15. The pack of claim 13, wherein the inner tab is provided with a corner to engage the body front panel when the pack is closed to resist opening of the lid and a curved edge extending away from said corner, wherein said curved edge is shaped to remain substantially clear of the body front panel during opening of the lid.

16. The pack of claim 13, wherein the inner tab coplanar with the lid side panel engages the body front panel when the pack is closed by having an overlap with the body front panel in the range 0.3-3 mm.

17. The pack of claim 16, wherein the inner tab coplanar with the lid side panel engages the body front panel when the pack is closed by having an overlap with the body front panel in the range 0.5-2 mm.

18. The pack of claim 17, wherein the inner tab coplanar with the lid side panel engages the body front panel when the pack is closed by having an overlap with the body front panel of approximately 1 mm.

19. The pack of claim 13, wherein the inner tab of the lid side panel is shaped to engage a restraining member having a complementary shape on the inside of the corresponding body side panel.

20. The pack of claim 19, wherein the inner tab includes a protrusion that engages a complementary notch in the restraining member.

21. The pack of claim 19, wherein each body side panel comprises an inner layer and an outer layer, and wherein said restraining member forms part of said inner layer.

22. The pack of claim 13, wherein said diagonal extension comprises a continuation at the same angle of a diagonal forming the top edge of the body side panel.

23. The pack of claim 13, wherein said inner tab is formed from material folded in from the back panel of the lid.

* * * * *